US006095053A

United States Patent [19]

Johnsen et al.

[11] Patent Number: 6,095,053

[45] Date of Patent: Aug. 1, 2000

[54] BULK SPIKE LOADING SYSTEM

[75] Inventors: David S. Johnsen, Wauwatosa, Wis.; Robert M. Weber, Wadsworth, Ill.; William D. Straub, Milwaukee; Bruce M. Boczkiewicz, Mukwonago, both of Wis.

[73] Assignee: Nordco Inc., Milwaukee, Wis.

[21] Appl. No.: 09/182,261

[22] Filed: Oct. 29, 1998

[51] Int. Cl.[7] ..... E01B 29/26

[52] U.S. Cl. ..... 104/17.1; 198/550.1; 221/168; 221/182

[58] Field of Search ..... 104/2, 17.1, 17.2; 221/168, 169, 182, 186; 198/467.1, 550.1, 548, 389; 414/523, 526

[56] References Cited

U.S. PATENT DOCUMENTS

| | | | |
|---|---|---|---|
| 2,930,473 | 3/1960 | Campbell | 198/30 |
| 3,690,264 | 9/1972 | Plasser et al. | 104/17 R |
| 3,753,404 | 8/1973 | Bryan, Jr. | 104/17 R |
| 3,759,419 | 9/1973 | Iseli | 221/168 |
| 4,538,793 | 9/1985 | Dieringer et al. | 254/18 |
| 4,735,343 | 4/1988 | Herzog | 221/159 |
| 4,777,885 | 10/1988 | Deiringer | 104/17.1 |
| 4,909,375 | 3/1990 | Cotic et al. | 198/393 |
| 4,940,001 | 7/1990 | Holley | 104/17.1 |
| 5,191,840 | 3/1993 | Cotic et al. | 104/17.1 |
| 5,542,355 | 8/1996 | Madison et al. | 104/17.1 |
| 5,577,447 | 11/1996 | Weber et al. | 104/2 |
| 5,615,990 | 4/1997 | Grieshop | 198/550.1 |
| 5,636,574 | 6/1997 | Pierrot | 104/17.1 |

FOREIGN PATENT DOCUMENTS

| | | |
|---|---|---|
| 1171 718 | 6/1964 | Germany . |
| 29 05 492 | 8/1980 | Germany . |

*Primary Examiner*—S. Joseph Morano
*Assistant Examiner*—Lars A. Olson
*Attorney, Agent, or Firm*—Greer, Burns & Crain, Ltd.

[57] ABSTRACT

A bulk loader conveys rigid, stick-like articles in bulk. The bulk loader has a bin for holding a plurality of the articles and a trough connected to a bin having an entrance portion for receiving the articles from the bin and a discharge portion for discharging the articles. An auger, with an inlet end and an outlet end, is rotatably positioned in the trough so that the inlet end is positioned near the entrance portion and the outlet end is positioned near the discharge portion. Upon rotation of the auger, the auger conveys the articles from the entrance portion to the discharge portion. The trough is constructed and arranged to prevent conveyed articles from becoming jammed between said auger and said trough.

25 Claims, 4 Drawing Sheets

BULK SPIKE LOADING SYSTEM

BACKGROUND

The present invention relates generally to a bulk loading apparatus for storing and conveying stick-like articles, which includes a storage bin associated with a conveyor for moving articles from the storage bin to a delivery point. More particularly, the present invention relates to a railroad right of way maintenance device providing a bulk spike loading system which uses an inclined trough and auger assembly to move railroad spikes or other fasteners from a bulk storage bin to a desired location for loading the spikes into a spiker.

Among various types of railway maintenance equipment, automatic spikers are known and used for driving railroad spikes into railroad ties for securing the rail to the tie plates and tie plates to the ties. The spiker is typically mounted on a spiking machine capable of traveling over railroad tracks and may be self propelled or towable. A suitable example of such a spiker is disclosed in commonly owned U.S. Pat. No. 5,191,840 which is incorporated by reference. During operation of typical spikers, workers fill kegs with spikes held in a separate car, or wagon, and load the filled kegs onto the spiking machine. A first worker then removes spikes from the keg, as needed, and places them in the spiker magazine. A second worker then operates the aiming and driving mechanism of the spiker to drive the spike where desired.

This conventional system requires a large amount of manual labor to load the kegs with spikes and then load the kegs onto the spiking machine. In addition, manually reaching into the kegs to get the spikes wastes further time. Furthermore, space is limited on the spiking machine, so that only a few kegs can be carried on the spiking machine at one time. This limits the production capacity of the spiking machine.

Thus, a main object of the present invention is to provide an improved bulk loader that efficiently stores and conveys relatively large quantities of spikes or other rail fastening articles, such as lag screws or clips, to a desired location for further operations.

A further object of the present invention is to provide an improved bulk loader for storing and conveying fastening articles that reduces the handling time for the particular fastening article.

Another object of the present invention is to provide an improved bulk loader that prevents jamming of the conveyed articles.

Yet another object of the present invention is to provide an improved removable bulk loader that provides more space for storing articles on a conventional spiking machine, while eliminating the need for ancillary equipment such as separate storage wagons.

SUMMARY OF THE INVENTION

The above-listed objects are met or exceeded by the present bulk loader. Features of the present invention include a rotating auger that conveys spikes or articles from a bin to a convenient location for further handling. Once emptied, the auger rotates within a trough that is connected to the bin. One end of the trough has a doorway to the bin and another end of the trough has a discharge opening for emptying the spikes to a convenient location. The entire bulk loader, including bin, trough and auger, can be removed from a spiking machine and reloaded or replaced with a bulk loader already loaded with spikes. Since it has been found that it is fairly difficult to convey, in bulk, articles like rail spikes, due to their inherent resistance to smooth flow and their tendency to become tangled with each other, the present bulk loader is provided with several features which are designed to prevent spikes or other fasteners from jamming in the conveyor mechanism, and to promote the flow of fasteners through the loader. These features include a specially configured auger trough doorway, an overflow slot for the auger, an agitation cycle for the auger motors and a special bin vibration motor.

More specifically, the present bulk loader includes a bin for holding a plurality of rigid, stick-like articles and a trough connected to the bin. The trough has an entrance portion for receiving the articles from the bin and a discharge portion for discharging the articles. An auger with an inlet end and an outlet end is rotatably positioned in the trough so that the inlet is near the entrance portion and the outlet is near the discharge portion. The auger is constructed and arranged so that upon rotation, the auger conveys the articles from the entrance portion to the discharge portion. The trough is constructed and arranged to prevent the articles from becoming jammed between the auger and the trough.

In another embodiment, the present invention provides a rail maintenance machine for driving rail fasteners such as spikes, and having a frame that supports a removable bulk loader. The bulk loader includes a bin with a storage area for holding the fasteners, and a trough connected to the storage area through a doorway. An auger rotates within the trough. In addition, a discharge chute is connected to a second opening on the trough to convey fasteners from the trough to a desired operational position.

DESCRIPTION OF THE PREFERRED EMBODIMENT

Figure 1:
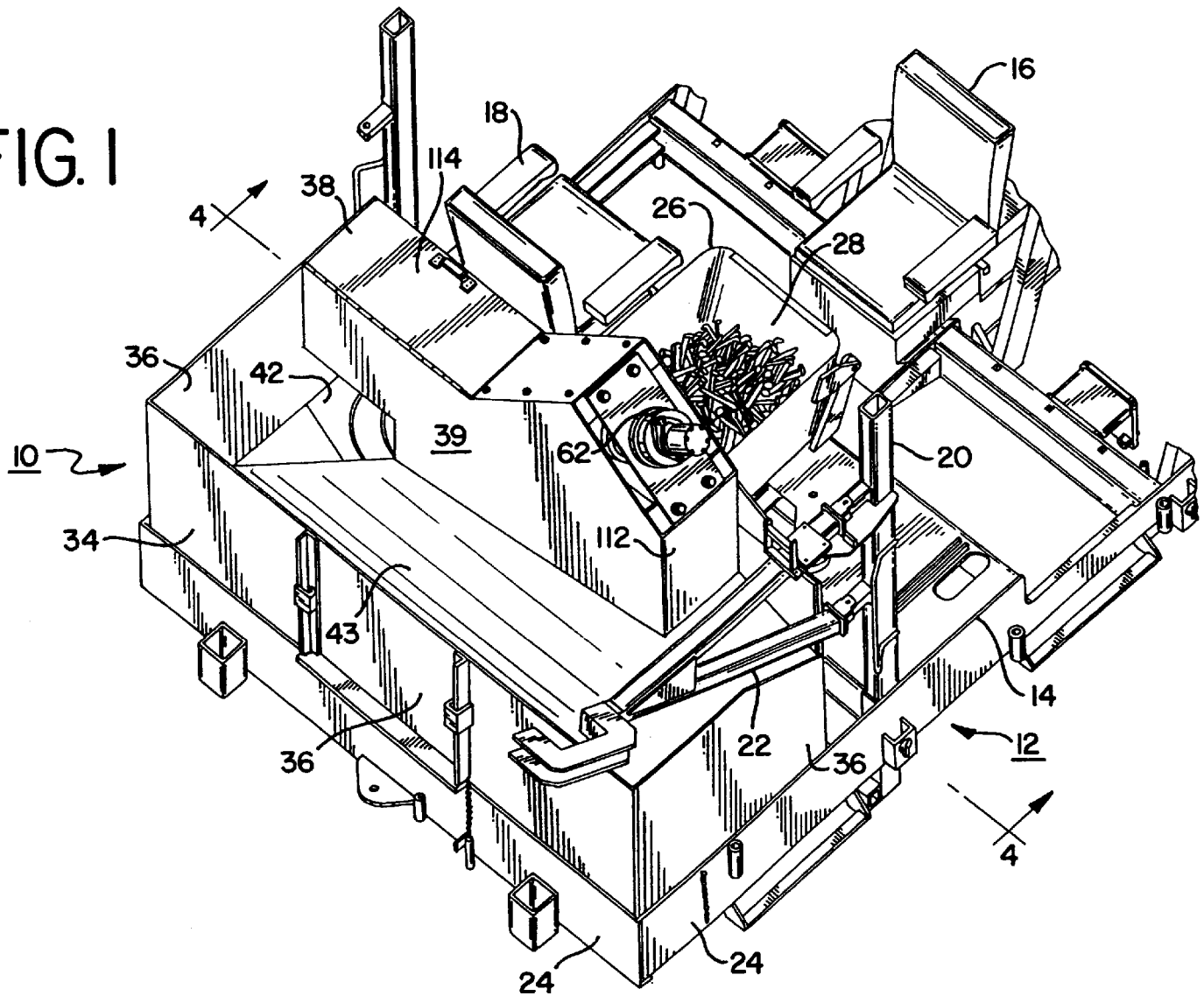
FIG. 1 is a fragmentary top perspective view of a spiking machine fitted with the preset bulk loader.
Figure 2:
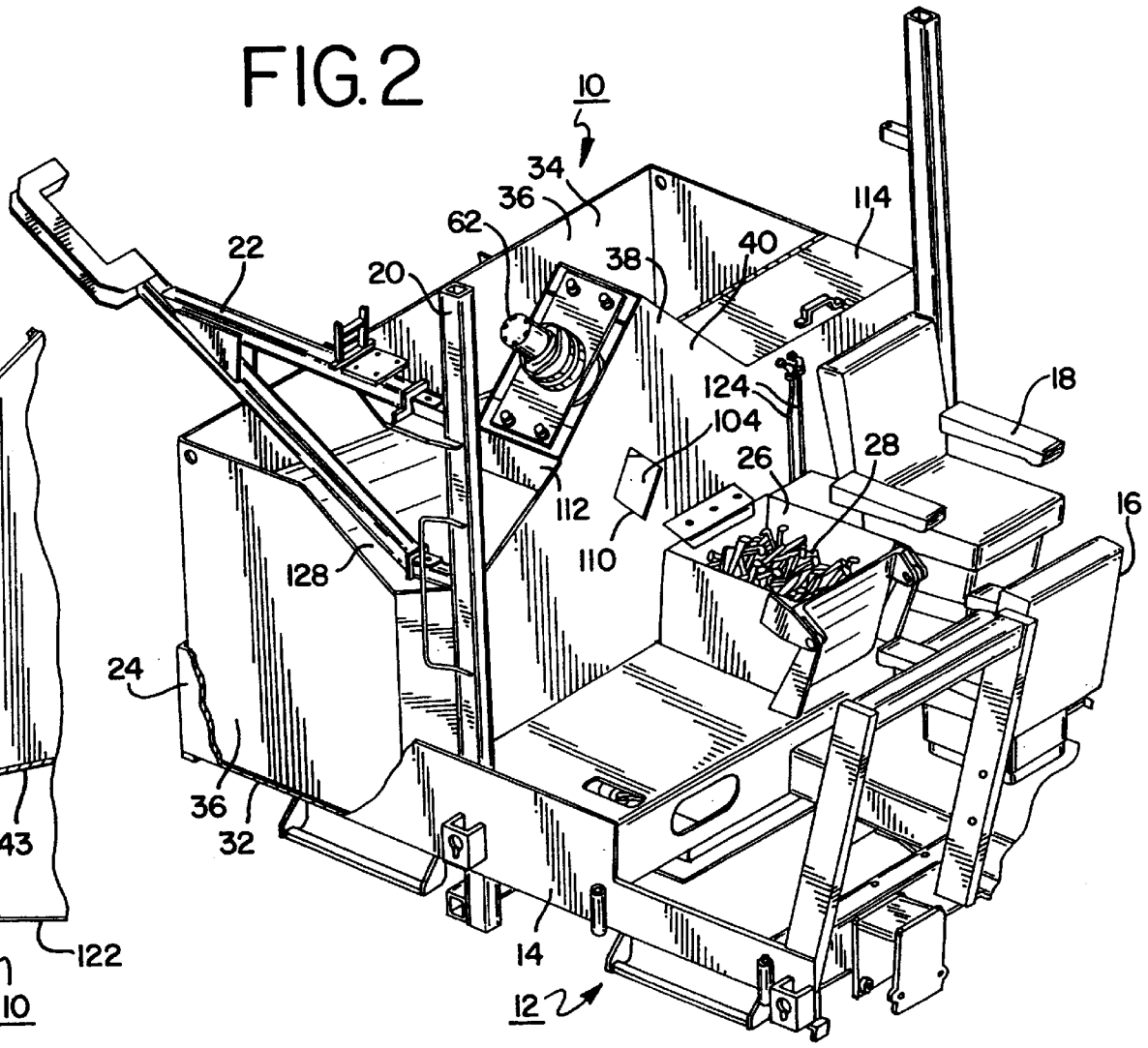
FIG. 2 is a fragmentary top perspective view of the spiking machine of FIG. 1 shown from a position forward of the operator.

Referring now to FIGS. 1 and 2, a bulk loader, generally designated 10, is shown on a portion of a spiking machine, generally designated 12. As is well known in the art, the spiking machine 12 is designed to be self propelled or towed as a separate unit along a railroad track. The spiking machine 12 preferably includes a frame 14 supporting, among other things, the bulk loader 10, a seat 16 facing the bulk loader, a seat 18 facing a spiker mechanism (not shown) and a post 20 supporting a boom 22.

The frame 14 also defines a retaining wall 24 for receiving and holding the bulk loader 10. As best seen in FIG. 2, the bulk loader 10 rests within a space defined by the retaining wall 24. The frame 14 also preferably supports a fastener delivery basket 26.

In the preferred embodiment, the bulk loader 10 loaded with rail maintenance fasteners, such as spikes 28 (shown here in the basket 26), is placed on the spiking machine 12 by cranes or other lifting devices known in the art. The bulk loader 10 is preferably free standing on at least three legs 30 (best seen in FIG. 3) which preferably rest in designated openings in a floor 32 of the frame 14.

The bulk loader 10 includes a bin 34 preferably having a generally rectangular configuration with three sidewalls 36 and a conveyor housing 38 mounted along a front wall 40 of the bin 34. A wall 39 of the conveyor housing 38 faces the interior of the bin 34. Rail fasteners, which are preferably cut spikes 28, but are also contemplated as being hairpin spikes, lag screws, rail anchors or even rail clips, are loaded in random or bulk fashion into the bin 34 and enter the conveyor housing 38 through a doorway 42. A bottom 43 of the bin 34 is inclined toward the doorway 42 to direct spikes 28 toward the doorway 42 (best seen in FIG. 1A). The doorway 42 must be of sufficient size to provide a sufficient amount of spikes 28 to take full advantage of the capacity of an auger 46 while still preventing the spikes 28 from becoming jammed.

Figure 1A:
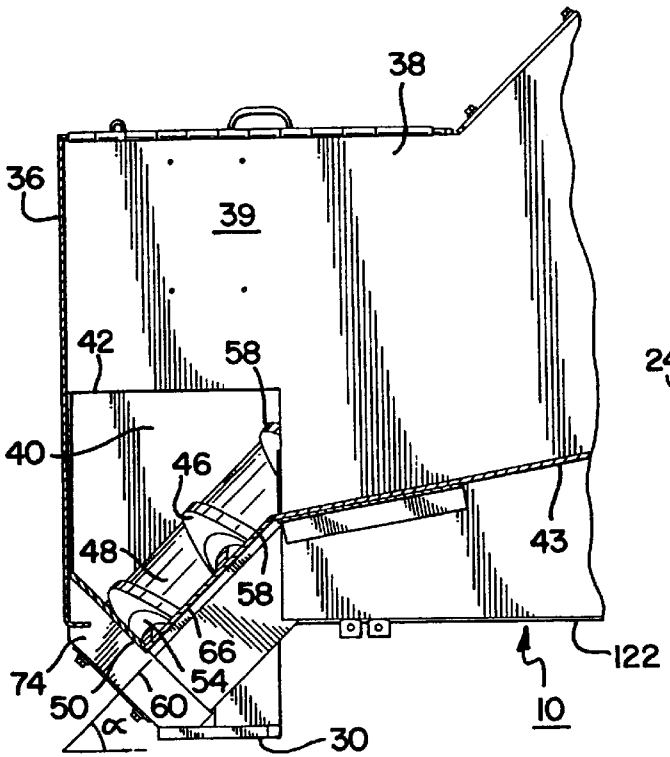
FIG. 1A is an enlarged view of a portion of the bulk loader shown in FIG. 1 taken partly in section.
Figure 4:
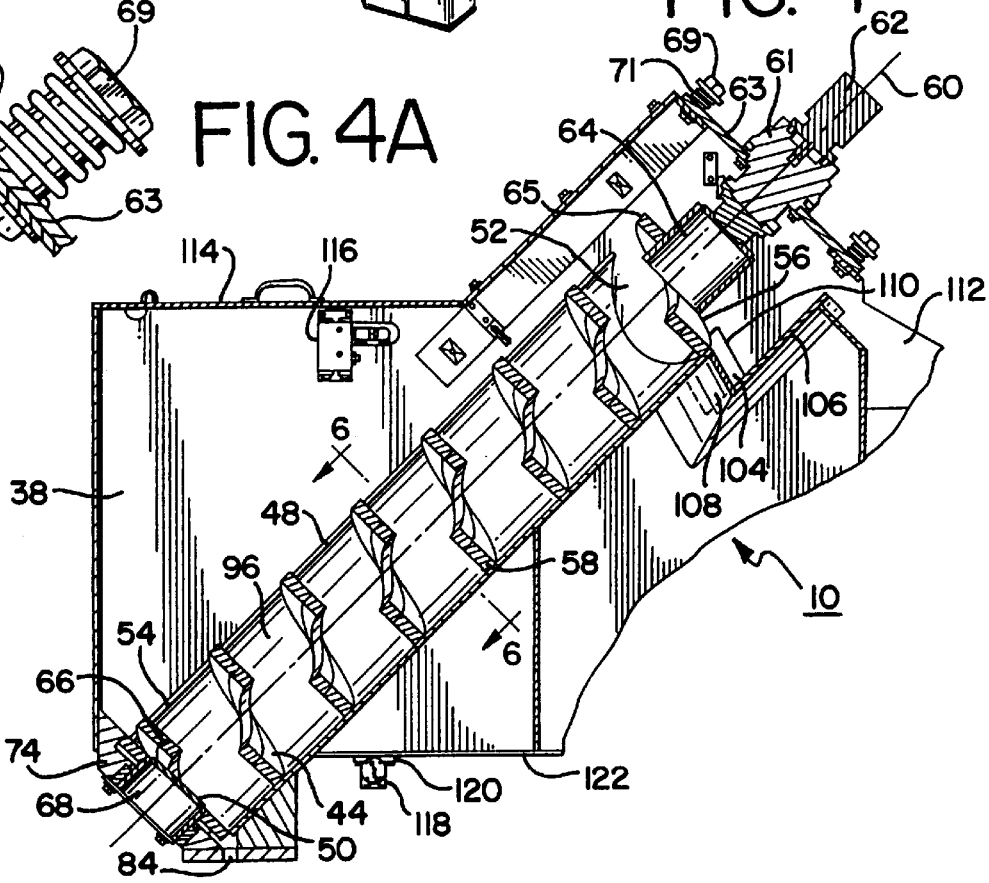
FIG. 4 is a sectional view taken along the line 4—4 of FIG. 1 and in the direction generally indicated.

Referring now to FIGS. 1A and 4, the conveyor housing 38 includes a trough 48 with an entrance portion 50 and a discharge portion 52 that provides a shell for the auger 46, which has an inlet end 54, an outlet end 56 and a plurality of helically arranged flights 58. The flights 58 have a diameter which approximates the interior diameter of the trough 48 to create a minimum clearance between these components to prevent spikes jamming in the clearance. Such jamming prevents free movement of the auger. Although the auger 46 is preferably of the centerless type, with the flights 58 joined together to form a single piece, other auger configurations are contemplated, including center shaft augers. The auger 46 is preferably positioned so that the doorway 42 exposes a leading edge 44 of the auger.

The auger 46 and the trough 48 are also preferably inclined relative to a horizontal plane defined by the frame 14. In the preferred embodiment, the angle of inclination, (best seen in FIG. 1A) is 45°, however other degrees of inclination are contemplated. As such, the entrance portion 50 is positioned lower than the discharge portion 52, and is further positioned so that a longitudinal axis 60 of the trough (which is also the rotational axis of the auger 46) is generally parallel to a plane defined by the front wall 40 of the bin 34.

A motor 62 mounted on the conveyor housing 38 rotates the auger 46 inside the trough 48. The inventors contemplate the use of any type of mechanism causing rotation, whether hydraulic, electrical or otherwise; however, the motor 62 is preferably hydraulic, and is connected through a transmission 61 to an upper stub shaft 64 which is fixed, as by welding, to an uppermost flight 65. The motor 62 is also preferably mounted on a mounting plate 63. Bolts 69 attach the mounting plate 63 to the housing 38.

Figure 4A:
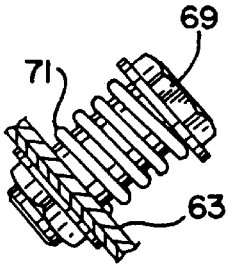
FIG. 4A is an enlarged view of a portion of the bulk loader show in FIG. 4.

Also in the preferred embodiment as shown in FIGS. 4 and 4A, springs 71 preferably wind around at least one of the bolts 69 between the heads of the bolts and the mounting plate 63. In the preferred embodiment, all four bolts 69 are provided with springs 71, however lesser numbers of springs are contemplated depending on the application. The springs 71 exert a biasing force to bias the motor 62, the mounting plate 63 and auger 46 downward along the longitudinal axis 60 relative to the housing 38. When spikes 28 or other articles become jammed in the auger 46, at a certain point the biasing force of the springs 71 is overcome and the springs are compressed. The motor 62, mounting plate 63 and auger 46 then move upward along the longitudinal axis 60 to release the jam. This axial movement of the auger 46 is called a "jam-release" or "biasing release". While spiral springs are preferred for the jam-release mechanism, any device that biases the motor mounting plate 63 and auger 46 downward, toward the housing 38 is contemplated, including fluid power cylinders.

Figure 5:
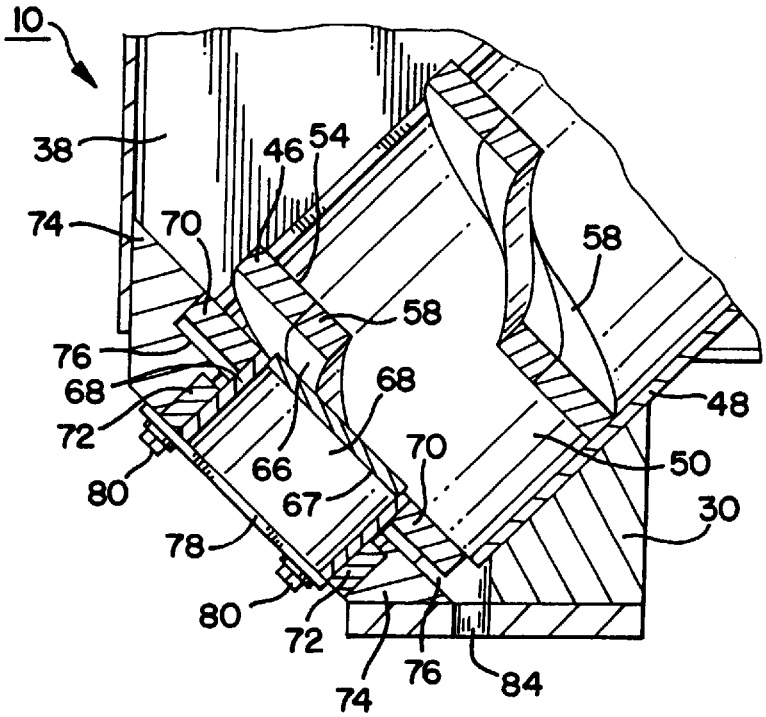
FIG. 5 is an enlarged fragmentary view of the bulk loader as shown in FIG. 4.

Referring now to FIGS. 4 and 5, the inlet or lower end 54 of the auger 46 and the entrance portion or bottom 50 of the trough 48 are attached to the conveyor housing 38 so that the auger 46 is free to rotate, while the trough 48 is preferably fixed to the conveyor housing. As shown in FIG. 5, a lowermost flight 66 is fixed to a plate 67 and to a lower stub shaft 68. In the preferred embodiment, the stub shaft 68 is hollow. An annular disc 70 is also fixed to an exterior of the lower stub shaft 68. The lower shaft stub 68 is journaled in a bearing 72 which is held in a bearing block 74. The bearing block 74 also defines a pocket 76 so that the disc 70 can rotate freely. An end plate 78 supports the end of the lower stub shaft 68 and is attached to the bearing block 74, preferably by threaded fasteners 80.

As the auger 46 is rotated by the motor, the plate 67, the disc 70 and the end plate 78 close off the lower end of the auger. The relatively small clearance left between the plate 70 and the bearing block 74 prevents spikes 28 from becoming jammed between the disc 70 and the flights 58, and/or between the disc 70 and the pocket 76. The pocket 76 also has a drain opening 84 to prevent water, metal shavings or other debris from building up inside the trough 48 and causing further jams.

Figure 6:
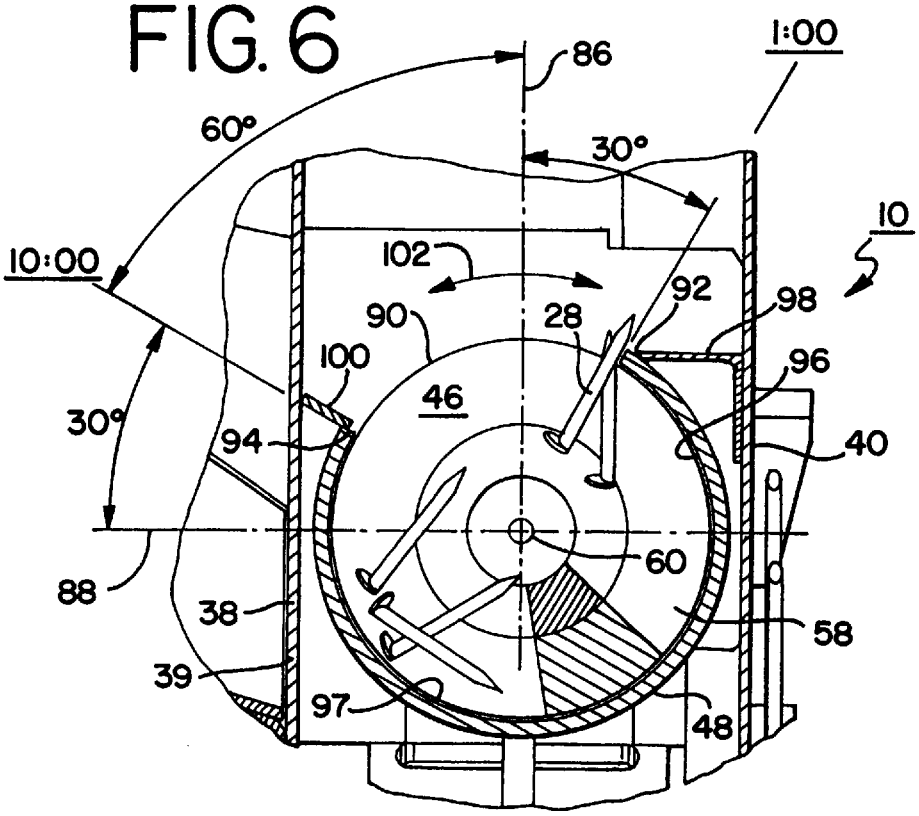
FIG. 6 is a sectional view taken along the line 6—6 of FIG. 4 and in the direction generally indicated.

Referring now to FIG. 6, another feature of the trough 48 of the present bulk loader 10 is depicted. A vertical line 86 and a horizontal line 88 intersect at the rotational axis 60. From this view, the trough 48 generally has a "C"-shape with the opening in the "C" defining an overflow opening 90 that runs the length of the trough from near the entrance portion 50 to the discharge portion 52. The trough 48 also defines a leading edge 92 and a trailing edge 94 of the overflow opening 90. With the vertical line 86 defining a 12:00 position and the rotational axis 60 defining a center of a clock, the leading edge 92 is preferably placed at about the 1:00 position, or 30° clockwise from the vertical line 86, and the trailing edge 94 is preferably placed at about the 10:00 position, or 30° clockwise from the horizontal line 88 (or 60° counterclockwise from the vertical line 86). This positioning of the edges 92, 94 of the overflow opening 90 substantially increases the likelihood of any jammed or misaligned spikes 28 having any portion protruding beyond the perimeter of the trough 48 hitting the edges of the overflow opening 90. Thus, the edges 92, 94 act as scrapers, and are configured to push spikes 28 back into the auger 46 rather than becoming lodged between a periphery of one of the flights 58 and an inner surface 96 of the trough 48. It has been found that the "past-center" 1:00 position of the leading edge 92 facilitates the dropping of misaligned spikes back into a floor 97 of the trough.

In addition, brackets 98 and 100 are placed between the edges 92, 94 and the corresponding walls 39, 40. The brackets 98, 100 preferably extend along the length of the overflow opening 90, generally parallel to the rotational axis 60 of the auger 46, from the discharge portion 52 of the trough 48 to near the doorway 42. By closing off the space in the conveyor housing 38, the brackets 98 and 100 further ensure that the spikes 28 are forced back into the auger 46 and do not jam the auger 46 or become jammed between the conveyor housing and the trough.

Another feature of the invention is an agitation mode in which the auger 46 is cyclically and alternately rotated in two directions, as shown by the arrows 102 in FIG. 6. The agitation mode involves an operational cycle of the motor 62 such that it alternates between rotating the auger 46 in a first direction (such as clockwise or forward) and then periodically reversing the direction of rotation of the auger (such as counterclockwise or backward). Although many other settings and combinations can be used, preferably one such agitation cycle occurs when the auger 46 is rotated one complete turn (360°) in a first direction, and then turned ⅛ turn (45°) in a second direction reverse to the first direction. In the preferred embodiment, the above-described cycle is repeated. It has been found that this feature shakes any jammed or tangled spikes 28 free and helps to convey the spikes forward in the auger 46.

Figure 3:
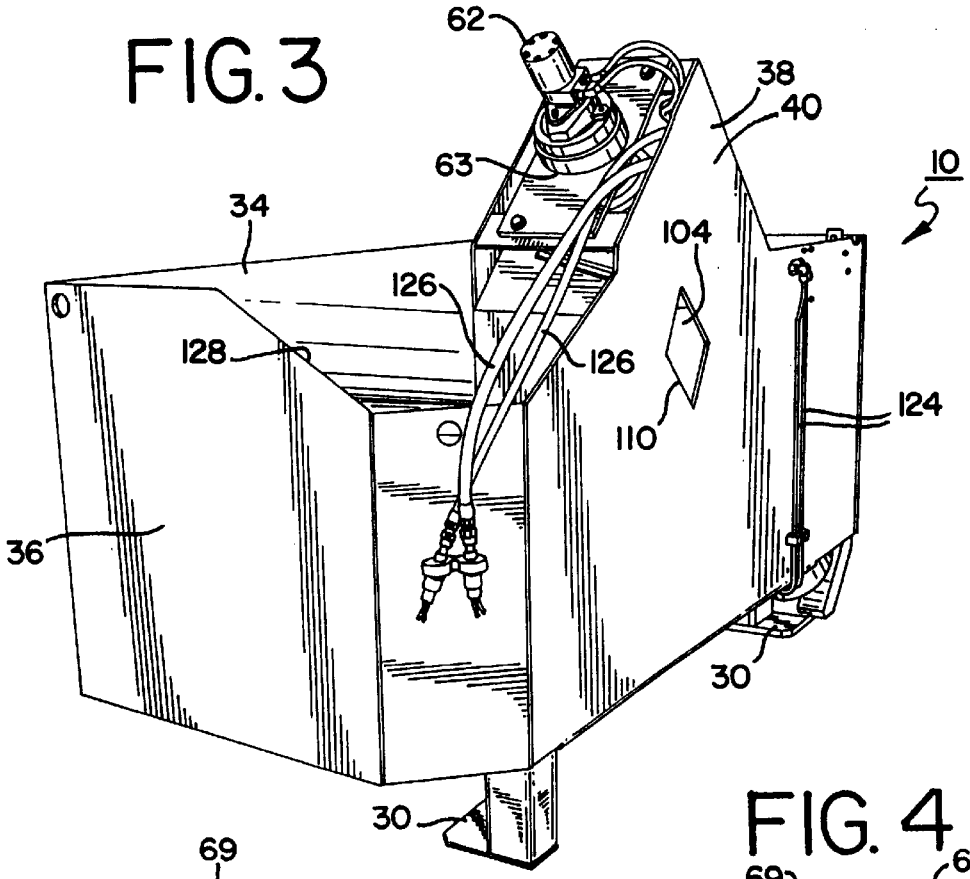
FIG. 3 is a front perspective view of the bulk loader of the present invention.

Referring now to FIGS. 3 and 4, the discharge portion 52 of the trough 48 is positioned near the outlet 56 that defines an opening to a discharge chute 104. The discharge chute 104 has a catch floor 106, and a wall 108 for connecting the trough 48 to the catch floor 106 (best seen in FIG. 4). Spikes 28 fall out of the trough 48 and onto the catch floor 106 or slide down the wall 108 to the catch floor 106. The catch floor 106 is preferably positioned two to three inches below the discharge portion 52 to prevent jams in the discharge portion and the discharge chute 104. A loader outlet 110 for the discharge chute 104 is located on the front wall 40 of the conveyor housing 38. The loader outlet 110 is preferably diamond shaped, and is in communication with the intersection of the catch floor 106 and the wall 108, which are inclined toward two lower sides of loader outlet 110. Spikes 28 are emitted from the loader outlet 110 in a direction transverse to the rotational axis 60, and are caught in the basket 26 (best seen in FIG. 2).

The conveyor housing 38 also has an overflow chute 112 (best seen in FIG. 4) which is disposed in the housing so that spikes 28 that are ejected from the discharge portion 52 and overshoot the discharge chute 104 and the catch floor 106 are returned to the bin 34 through the overflow chute 112. In addition, the top of the conveyor housing 38 is fitted with a door 114 for access to the auger 46 or for mounting space which can be used for control equipment 116 required by the motor 62, such as hydraulic controls and connections to power supplies.

Referring again to FIGS. 3 and 4, the present bulk loader 10 also is preferably provided with a vibration motor 118 for vibrating the bin 34 to free or unjam the spikes 28, and for facilitating their movement toward the doorway 42. In the preferred embodiment, the motor 118 is hydraulic, but electrical or other types of motors are also contemplated. The vibration motor 118 is connected to an elongate channel or block 120 which is skip-welded to an underside 122 of the bottom 43 of the bin 34. The skip welding helps to transfer the forces generated by the vibration motor 118 to the bottom 43. Hydraulic lines 124 for controlling the vibration motor 118 run under the bin 34 and the conveyor housing 38, and up the front wall 40 of the conveyor housing, for connection to the control equipment 116. Another set of main lines 126 (best seen in FIG. 3) connects the control equipment 116 to the spiking machine 12. To vibrate the supply of spikes 28 in the bin 34, the motor 118 may be operated alone, or in combination with the motor 62 employing its reversing cycle described above.

In operation, the spikes 28 are directed toward the trough 48 by vibration of the bin 34 and the inclined bottom 43 of the bin. Then, the spikes 28 in the bin 34 slide through the doorway 42 in the conveyor housing 38, and enter the entrance portion 50 of the trough 48. Once they progress far enough past the doorway 42, the spikes 28 are engaged by the inlet 54 of the auger 46. The rotating auger 46 conveys the spikes 28 upward to the outlet 56 of the auger 46. Any spikes 28 lifting out of the overflow opening 90 before reaching the outlet 56 fall back into the overflow opening 90 due to the positioning of the edges of the openings 92, 94 and the brackets 98, 100.

Upon reaching the outlet 56 of the auger 46, the spikes 28 are ejected from the discharge portion 52 of the trough 48 and land in the discharge chute 104 or the overflow chute 112. If the spikes 28 land in the discharge chute 104, they slide out of the loader outlet 110 into the basket 26. If the spikes 28 land in the overflow chute 112, they fall back into the bin 34. Once the bulk loader 10 is emptied of the spikes 28, an operator has the option of replacing the empty bulk loader with a full bulk loader or using the boom 22 to lift containers (not shown) of spikes 28 to reload the bulk loader. An upper corner 128 of the bin 34 is preferably provided with a reduced height to accommodate the pivoting action of the boom 22. Alternatively, a pay loader can load spikes directly into the bin.

Thus, the present bulk loader provides several features designed to address the particular problems of conveying stick-like articles in bulk, such as rail spikes. These features include the appropriate dimensioning of the doorway 42, the closing off of the lower end of the auger 46 with the disc 70 and the end plate 78, the scraper-like orientation of the trough edges 92, 94, the construction of the discharge chute 104 which allows free-fall exiting of spikes, the cyclic operation of the auger motor 62, the supplemental vibration motor 118 and the springs 71 on bolts 69 providing the jam-release function.

Finally, the inventors also contemplated using the bulk loader in a "reverse operation." This can occur when spikes 28 are removed from railroad tracks during maintenance and are placed, one at a time, or in small numbers in the doorway 42 or the entrance portion 50 of the trough 48 so that the auger 46 can deliver the spikes 28 to the discharge portion 52 of the trough for further bulk storage.

While a particular embodiment of the bulk spike loader apparatus of the invention has been shown and described, it will be appreciated by those skilled in the art that changes and modifications may be made thereto without departing from the invention in its broader aspects and as set forth in the following claims.

What is claimed is:

1. A bulk loader for conveying rigid, stick-like articles in bulk, comprising:

a trough having an entrance portion for receiving the articles and a discharge portion for discharging the articles;

an auger with an inlet end and an outlet end, said auger being rotatably positioned in said trough, said inlet end being positioned near said entrance portion and said outlet end being positioned near said discharge portion;

said auger being constructed and arranged so that upon rotation, said auger conveys the articles from said entrance portion to said discharge portion; and said trough being constructed and arranged to prevent the articles from becoming jammed between said auger and said trough.

2. The bulk loader as defined in claim 1, further comprising a bin for holding a plurality of articles, said bin is disposed in an operational relationship with said entrance portion of said trough and defines a doorway to said entrance portion of said trough.

3. The bulk loader as defined in claim 2, wherein said bin further includes a bottom inclined toward said doorway and constructed and arranged so that the articles in said bin fall toward said doorway.

4. The bulk loader as defined in claim 1, further comprising a bin for holding a plurality of articles, said bin has a front wall and a plurality of sidewalls, said trough is in contact with said front wall and has a longitudinal axis, said trough is disposed in said bin so that said longitudinal axis is generally parallel to said front wall.

5. The bulk loader as defined in claim 1, further including a disc being fixed to said inlet end of said auger so that said disc rotates with said auger and defines a floor for said auger.

6. The bulk loader as defined in claim 1, wherein said entrance portion of said trough is configured for rotatably supporting said inlet end of said auger, said auger being supported in said trough only at said inlet end and said outlet end.

7. The bulk loader as defined in claim 6, wherein said entrance portion of said trough defines a pocket dimensional for accommodating said inlet end, and said pocket has a drain opening for releasing water or debris caught within said trough.

8. The bulk loader as defined in claim 1, wherein said entrance portion of said trough further defines a drain for releasing water or debris caught within said trough.

9. The bulk loader as defined in claim 1, wherein said trough has a length, is generally C-shaped in cross section and has a pair of upper edges defining an overflow opening, said opening generally extending the length of said trough and being configured for preventing individual articles from escaping or becoming jammed between or in one of said trough and said auger.

10. The bulk loader as defined in claim 9, wherein said two edges define a leading edge of said overflow opening and a trailing edge of said overflow opening, when said trough is viewed in section, said leading edge is generally disposed at a 10:00 position and said trailing edge is generally disposed at a 1:00 position.

11. The bulk loader as defined in claim 1, further including a discharge chute defining a catch floor, said discharge chute being attached to said discharge portion of said trough, said catch floor being positioned to catch the articles falling out of said trough from said discharge portion, said catch floor being positioned a sufficient distance away from aid discharge portion so that said distance defines a drop for the articles for preventing the jamming of the articles in said discharge chute.

12. The bulk loader as defined in claim 11, wherein said discharge chute further includes a wall connecting said catch floor to said discharge portion of said trough, said catch floor being inclined toward a base of said wall for directing the articles ejected from said outlet away from said trough.

13. The bulk loader as defined in claim 1, wherein said trough and said auger are inclined relative to said bin so that said entrance portion is lower than said discharge portion.

14. The bulk loader as defined in claim 1, further including rotational drive means for rotating said auger, and said auger being supported at said outlet end by said rotational drive means, and at said inlet end by a bearing.

15. The bulk loader as defined in claim 14, wherein said rotational drive means includes an agitation mode configured for providing a first rotation of said auger in a first direction and then having a second rotation of said auger in a reverse direction in the opposite direction of said first direction, and maintaining cyclic repetition of said first and second rotations.

16. The bulk spike loader as defined in claim 15, wherein said first rotation is approximately one complete 360° turn and said second rotation is approximately a 45° turn.

17. The bulk loader as defined in claim 1, further including a bin for holding a plurality of articles, said bin disposed in an operational relationship with said entrance portion of said trough, and including a vibrator mechanism for vibrating said bin so that said vibration causes said articles to move freely into said entrance portion.

18. The bulk spike loader as defined in claim 17, wherein said vibrating mechanism is attached to said bin and is skip welded to said bin for transmitting said vibration.

19. The bulk loader as defined in claim 1, further comprising an overflow chute connected to said discharge chute and providing a path from said discharge chute to said bin so that the articles ejected from said discharge portion which overshoot said discharge chute will land in said overflow chute.

20. The bulk loader as defined in claim 1, wherein said auger further defines a longitudinal axis and the bulk loader further comprises biasing release means for biasing said auger in a first direction along said longitudinal axis while permitting said auger to move in a second direction, opposite to said first direction, along said longitudinal axis when a specific amount of pressure is applied to said auger.

21. The bulk loader as defined in claim 20, further comprising a housing at least partially covering said auger, and wherein said biasing release means includes at least one spiral spring mounted on at least one bolt, said bolt attaching said auger to said housing.

22. A rail maintenance apparatus having a machine for removing or installing rail fasteners, comprising:

a frame;

a bulk loader positioned on said frame, said bulk loader including:

a bin having a storage area for holding the fasteners;

a trough disposed in an operational relationship with said bin, said trough defining a first opening to said storage area; and an auger rotatably positioned in said trough.

23. The maintenance apparatus as defined in claim 22, wherein said bulk loader is removable from said frame.

24. The maintenance apparatus as defined in claim 23, wherein said bin further includes a bottom and support legs extending downward from said bottom so that said support legs removably engage said frame.

25. The maintenance apparatus as defined in claim 22, further comprising a discharge chute disposed in an operational relationship with a second opening of said trough, said discharge chute positioned to convey the fasteners to a desired operational position on the maintenance apparatus.

* * * * *